US005261995A

United States Patent [19]

Golden

[11] Patent Number: 5,261,995

[45] Date of Patent: Nov. 16, 1993

[54] PIPE WRAPPING APPARATUS AND METHOD

[75] Inventor: Ronald W. Golden, Hamilton, Canada

[73] Assignee: Shaw Industries Ltd., Rexdale, Canada

[21] Appl. No.: 997,422

[22] Filed: Dec. 28, 1992

[51] Int. Cl.[5] ..... B65H 81/00

[52] U.S. Cl. ..... 156/428; 156/187; 156/195; 156/429; 156/446

[58] Field of Search ..... 156/187, 188, 195, 392, 156/324, 425, 428, 429, 446; 118/320, 321, 423, 424, 429

[56] References Cited

U.S. PATENT DOCUMENTS

| | | | |
|---|---|---|---|
| 3,544,405 | 12/1970 | Nakai et al. | 156/324 |
| 3,607,517 | 9/1971 | Pelley et al. | 156/195 |
| 3,623,930 | 11/1971 | Grosh | 156/195 |
| 3,740,291 | 6/1973 | Mallard . | |
| 4,006,049 | 2/1977 | Gardner . | |
| 4,081,302 | 3/1978 | Drostholm et al. | 156/195 |
| 4,333,783 | 6/1982 | Gardner . | |
| 4,544,426 | 10/1985 | Stockman | 156/187 |
| 4,785,854 | 11/1988 | Jarvis et al. | 156/187 |
| 4,878,976 | 11/1989 | Asakura | 156/195 |

*Primary Examiner*—David A. Simmons
*Assistant Examiner*—William J. Matney, Jr.

[57] ABSTRACT

The invention relates to a method and apparatus for wrapping pipe with a cementatious material such as concrete. The material is conveyed to the pipe as a continuous strip provided with notches along one edge and complementary notches are formed at the other edge of the strip as the strip is wrapped spirally onto the pipe. The continuous strip is formed in a hopper having a number of sections of successively reduced widths and containing rollers by which successive superimposed layer portions of the strip are formed with reinforcing mesh embedded between successive layer portions.

6 Claims, 6 Drawing Sheets

PIPE WRAPPING APPARATUS AND METHOD

This invention relates to an apparatus for and a method of wrapping a pipe with cementatious material, such as concrete, the pipe being rotated and advanced in relation to its longitudinal axis while a strip of wrapping material is delivered to the pipe at an angle to the longitudinal axis. Such apparatus is described, for example, in U.S. Pat. Nos. 4,544,426 (Stockman), 3,740,291 (Mallard), 4,006,049 (Gardner) and 4,333,783 (Gardner).

The strip of wrapping material generally comprises a carrier tape which carries a layer of the cementatious material, the layer being formed with notches along its edges which interlock along the wrapping seam as the material is wrapped onto the pipe so as to form an even coating. The layer of cementatious material may incorporate one or more layers of reinforcing mesh which protrude from one edge so as to overlap the wrapping seam.

In the known methods the wrapping strip is formed to the required configuration in the hopper at which the cementatious material is deposited onto the carrier tape as the carrier tape passes through the hopper. As the material leaves the hopper via a gate, it is moulded to the required thickness and configuration by a roller which carries one or more disks at one end, the disks being of larger diameter than the roller to form the notches along one edge. The notches at the other edge are typically formed by notching belts as described by Stockman.

It is important that the coating applied to the pipe be continuous and of an even thickness so that the desired weighting of the pipe is obtained and so that the coating once applied will be resistant to deterioration. Furthermore, if the material incorporates a reinforcing mesh, as it usually does, it is important that the mesh be accurately positioned in the layer and remain in position throughout the process. These things were recognized by Stockman, of course, who took important steps to mitigate the problems encountered in producing a satisfactory product. Nevertheless, in the current practice some of the problems remain. It has not been possible hitherto to achieve a consistent flow of material from the hopper to the pipe, or to obtain a layer of the cementatious material of uniform density throughout its cross section. The problem of obtaining a satisfactory wrapping strip becomes more acute when the strip incorporates multiple reinforcing meshes.

One reason for this is that the cementatious material in the hopper must work its way down through the reinforcing mesh to be embedded in it, thus weighing down on the mesh and displacing it from the selected level. Attempts to combat the problem by providing extended guides for the mesh and/or by applying more tension to it have failed to solve the problem of mesh displacement and/or distortion. Another reason is that when the notched strip of cementatious material is moulded by the roller and notching disk combination, the different peripheral speeds of the roller and the disk, acting on different parts of the strip, result in different compressive forces and non-uniformity of the material. This also results in forcing the reinforcing mesh out of position.

SUMMARY OF THE INVENTION

The present invention provides an improved way of forming the wrapping strip to the required configured configuration whereby to ensure uniform consistency of the cementatious material throughout its cross section and, in the case where a reinforcing mesh is incorporated, secure positioning of the mesh so that it will not be displaced or deformed in the forming process.

According to the invention, the hopper from which the cementatious material is deposited on the carrier tape is itself shaped to form the notched layer of material in the required configuration. The hopper has a vertical side wall which is stepped so as to provide a plurality of inline contiguous hopper sections, including at least a front section and a rear section, from which the material is deposited onto the carrier tape as it is continuously advanced thereunder. The hopper sections are of successively reduced widths from rear to front, and each hopper section houses a forming roller mounted horizontally across the whole width thereof. The distances of the rollers from the carrier tape increase successively from rear to front whereby to compress and form successive portions of the layer as they are laid in superimposed relation thereby to form the notched configuration of the layer.

One or more strips of reinforcing mesh may be fed through the hopper mouth, each strip passing under a respective roller, other than the roller of the front hopper section, and being laid thereby onto a layer portion by the roller as the layer portion is compressed. In this way the mesh is accurately positioned and becomes embedded between a pair of adjacent layer portions in the formed layer.

In this way the wrapping strip conveyed to the pipe is a flat strip with continuous notches formed along one longitudinal edge. Complementary notches are formed on the opposite edge, as the strip is applied to the pipe, for example by notching rollers.

BRIEF DESCRIPTION OF THE DRAWINGS

The preferred embodiment of the invention will now be described, by way of example, with reference to the accompanying drawings. In the drawings.

DESCRIPTION OF THE PREFERRED EMBODIMENT

Figure 1:
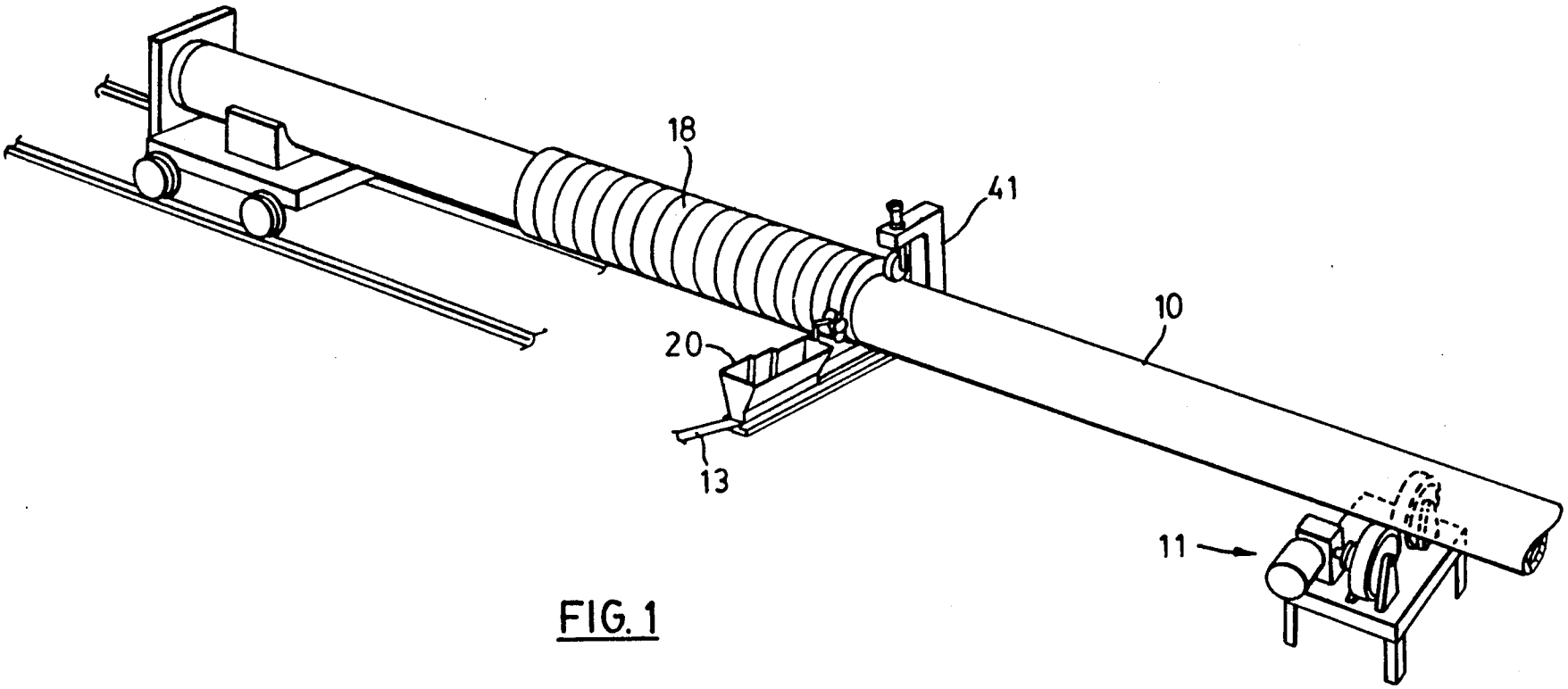
FIG. 1 is a simplified perspective view of a pipe being wrapped in accordance with the invention.

FIG. 1 shows a pipe 10 being conveyed and rotated by conventional conveyor means 11, while a wrapping strip 12 is delivered in a direction at an angle to the pipe 10 and wrapped onto it. The strip comprises a carrier tape 13 which carries a layer of coating material preferably having at least one continuous strip of reinforcing mesh embedded therein. The coating material in the present example is concrete having a low water content so that it will set quickly and have low plasticity. The wrapping strip is wrapped uniformly about the pipe 10 by the method described by Stockman, in which the edges of the layer of concrete 14 are provided with notches so that, upon wrapping, the strip overlaps with itself at a spiral seam 18 to ensure evenness of coating and continuity of the reinforcing mesh.

The method so far described is essentially the method described by Stockman, but the present invention is concerned with a novel apparatus for delivering and applying the coating material to the pipe in the required configuration. The apparatus and the method for forming, delivering and applying the coating material to the pipe will now be described with reference to FIGS. 2 to 6.

The concrete is supplied to a hopper 20 by way of a belt conveyor 21, the concrete passing into the mouth of the hopper 20 through a vibrating screen 22. The hopper 20 is mounted on a frame 23 which carries an endless conveyor 24. The carrier tape 13 passes under the hopper 20, from which the concrete is deposited onto it to form the layer 14. The layer 14 and carrier tape 13 pass onto the conveyor 24 which delivers the composite wrapping strip to the pipe. As shown in the drawings, the concrete layer 14 incorporates two layers of reinforcing mesh 16*a*, 16*b*, but for many applications it need carry only one layer of reinforcing mesh. For some applications more than two layers of reinforcing mesh may be required.

The layer of concrete 14, with the reinforcing mesh incorporated therein, is delivered from the hopper 20 via an adjustable exit gate 25, the overall thickness of the layer and the evenness of its upper surface being determined by a forming roller 26 mounted transversely across the hopper 20 at the exit gate 25. The positioning of the layers of reinforcing mesh 16*a*, 16*b* and the formation of notches 27 on one side of the layer 14 are effected by means of additional rollers 28, 29 mounted transversely across the hopper 20 at different heights and rearwardly of the roller 26. For this purpose the hopper 20 has one vertical longitudinal side 30 which is stepped so as to define three hopper sections of successively reduced widths from the rear end 31 to the exit gate 25 of the front end 32. The opposite longitudinal side 33 of the hopper is sloped outwardly to provide a flared mouth to the hopper, the bottom end of the side 33 being sloped inwardly for moulding a bevelled edge on the formed concrete layer 14.

Each of the hopper sections houses a respective one of the rollers 26, 28, 29, the length of each roller corresponding to the width of the respective hopper section so as to extend horizontally across its width. The rollers are mounted at different heights in the hopper 20. The forming roller 26 of the front hopper section is positioned to determine the thickness of the concrete layer 14 delivered to the pipe 10; the roller 28 in the mid-section is positioned to determine the level of the reinforcing mesh 16*a* within the concrete layer; and the roller 29 in the rear hopper section is positioned to determine the height of the other reinforcing mesh 16*b* within the concrete layer. The roller heights within the hopper sections can be adjusted by means of screw jacks (not shown) to suit different product specifications. The strips of reinforcing mesh 16*a*, 16*b* are led into the hopper 20 through its mouth, and pass round the rollers so as to extend horizontally within the concrete layer at the required heights as the layer is formed.

In such an apparatus designed to produce a wrapping strip with just one layer of reinforcing mesh, the hopper would be designed with just two such hopper sections and just one roller such as 29 in addition to the forming roller 26.

Figure 2:
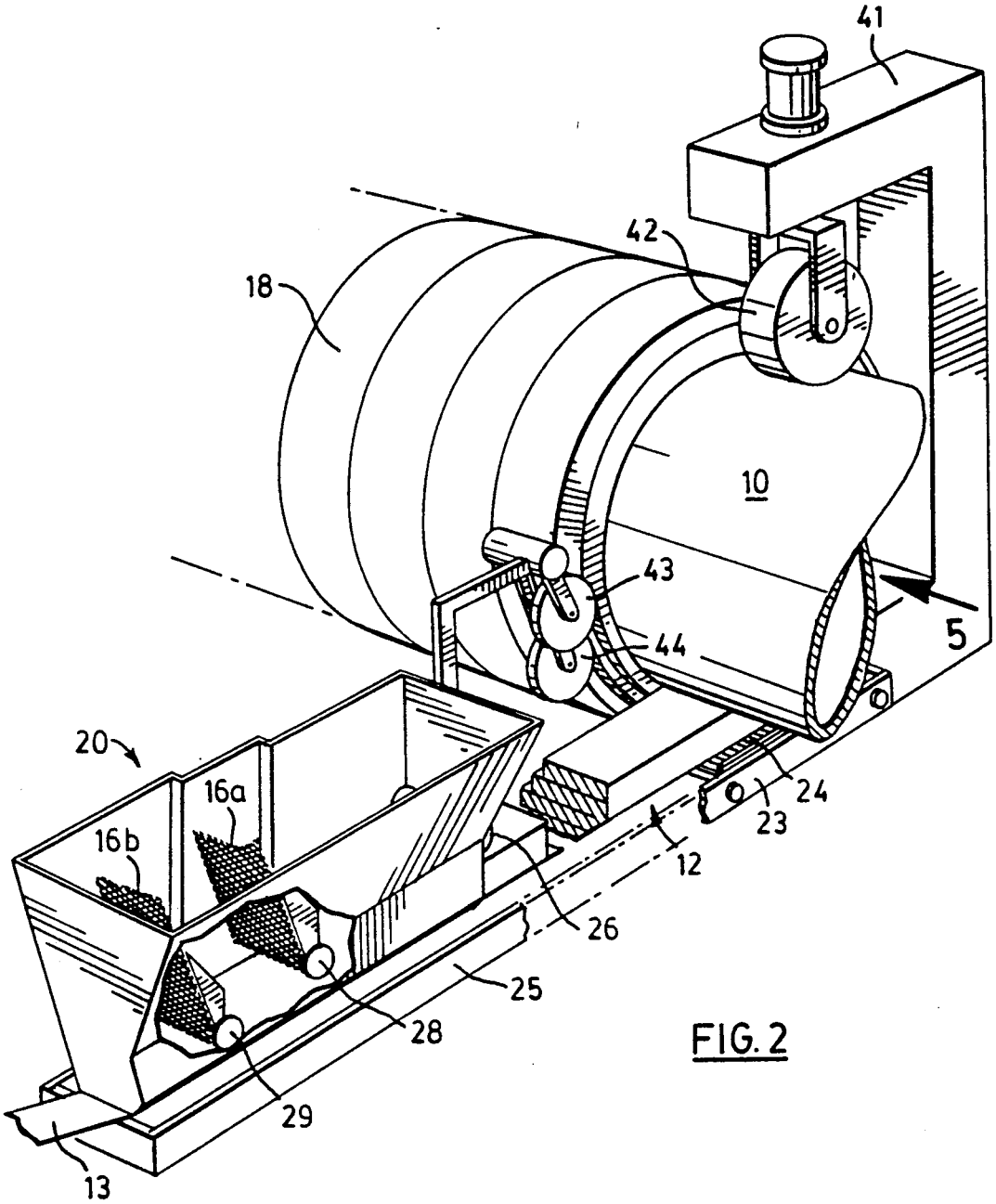
FIG. 2 is three-quarter rear perspective view, from one side of the apparatus showing its principal components.
Figure 3:
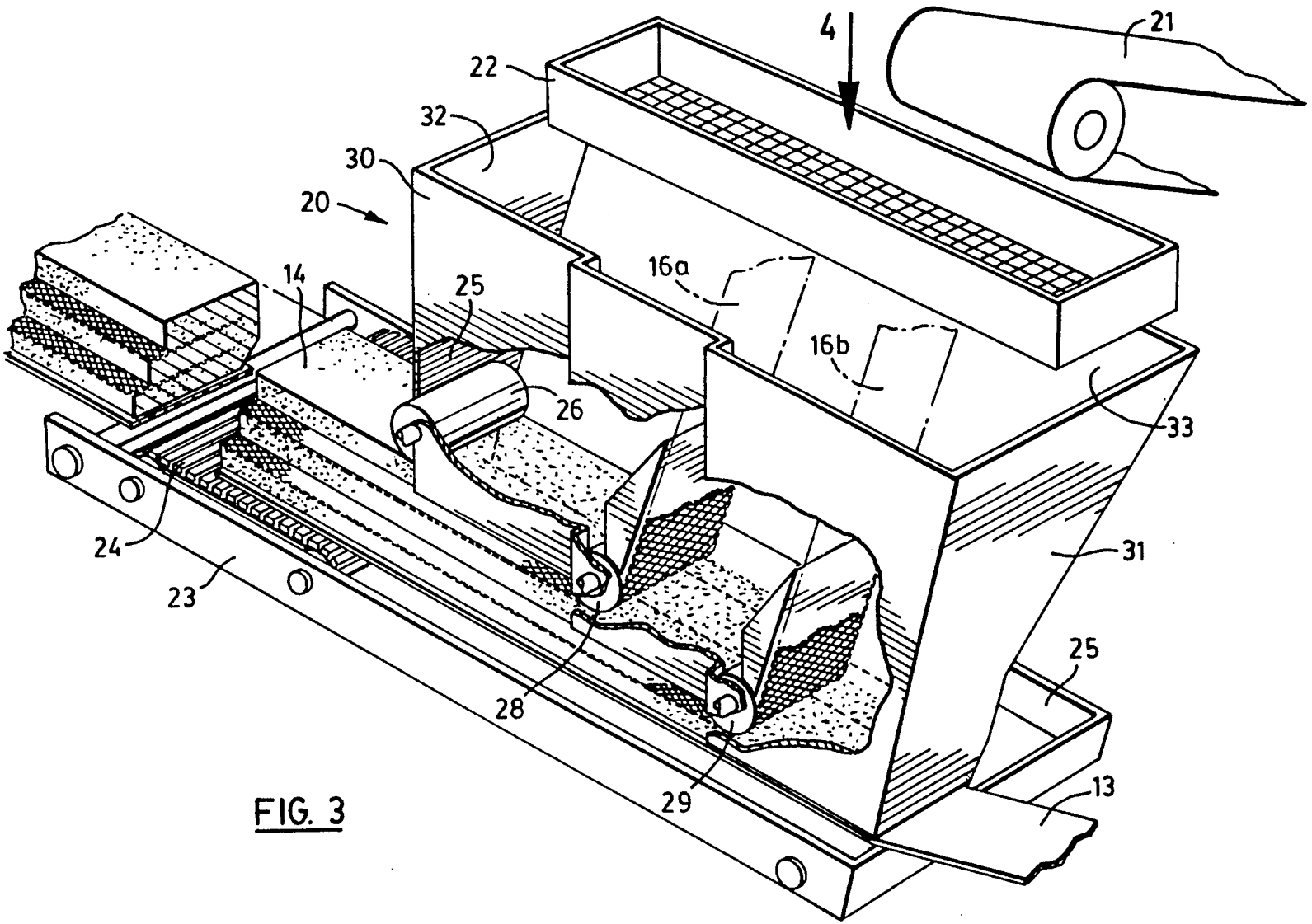
FIG. 3 is an enlarged perspective view, partly broken away, of the hopper and forming roller assembly of the apparatus.
Figure 4:
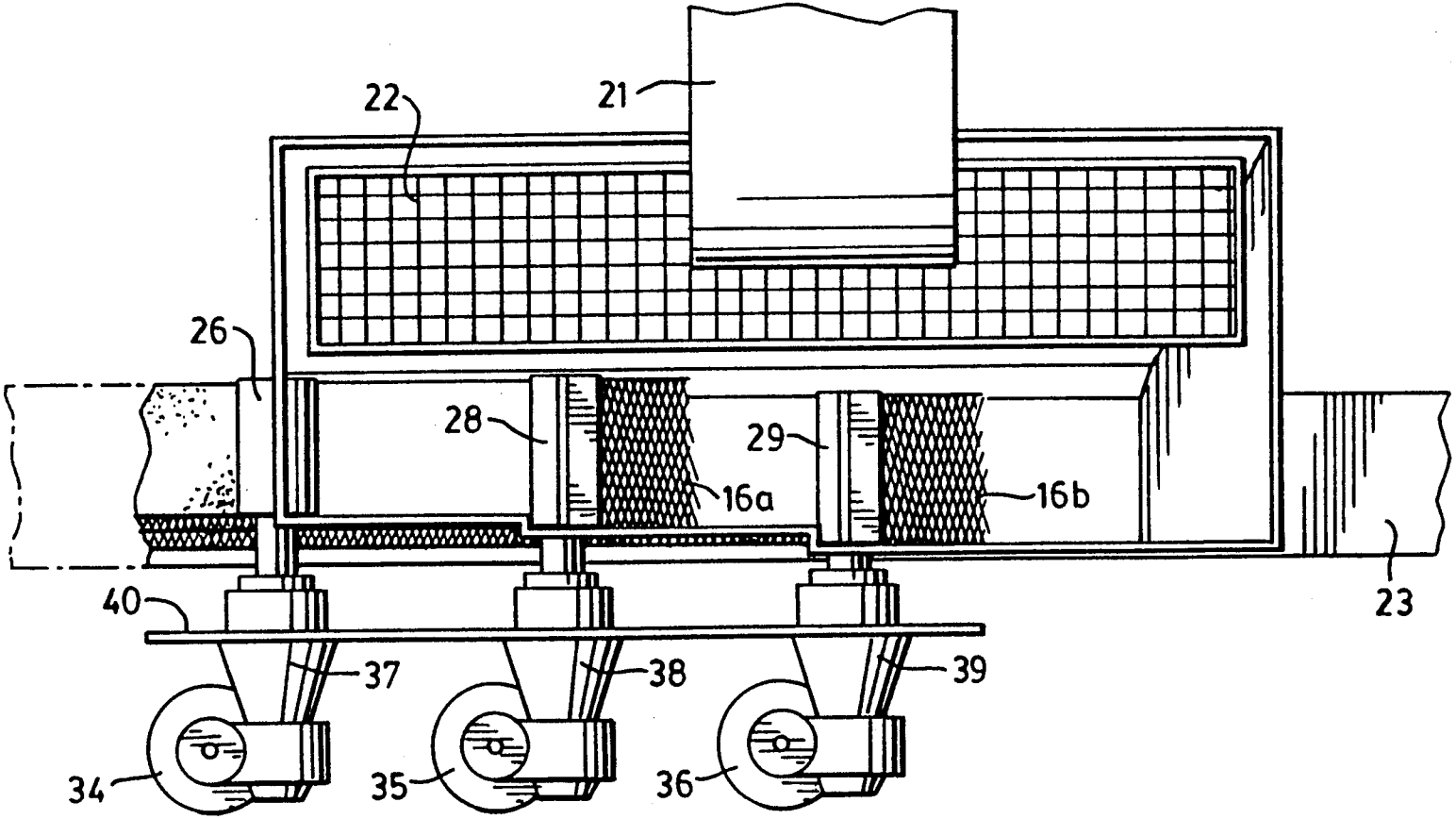
FIG. 4 is a scrap plan view in the direction of the arrow 4 in FIG. 3.

As shown in FIG. 4, the rollers 26, 28 and 29 are driven by separate motors 34, 35 and 36 through worm drives 37, 38 and 39, the motors and associated drive assemblies being mounted on a vertical plate 40 supported by and extending upwardly from the frame 23 of FIG. 2. The rollers are driven at slightly different speeds corresponding to the speeds at which the carrier tape 13, concrete layer 14 and reinforcing meshes 16*a*, 16*b* must be applied to the rotating pipe so that they will rotate with it at the same angular speed.

Figure 6:
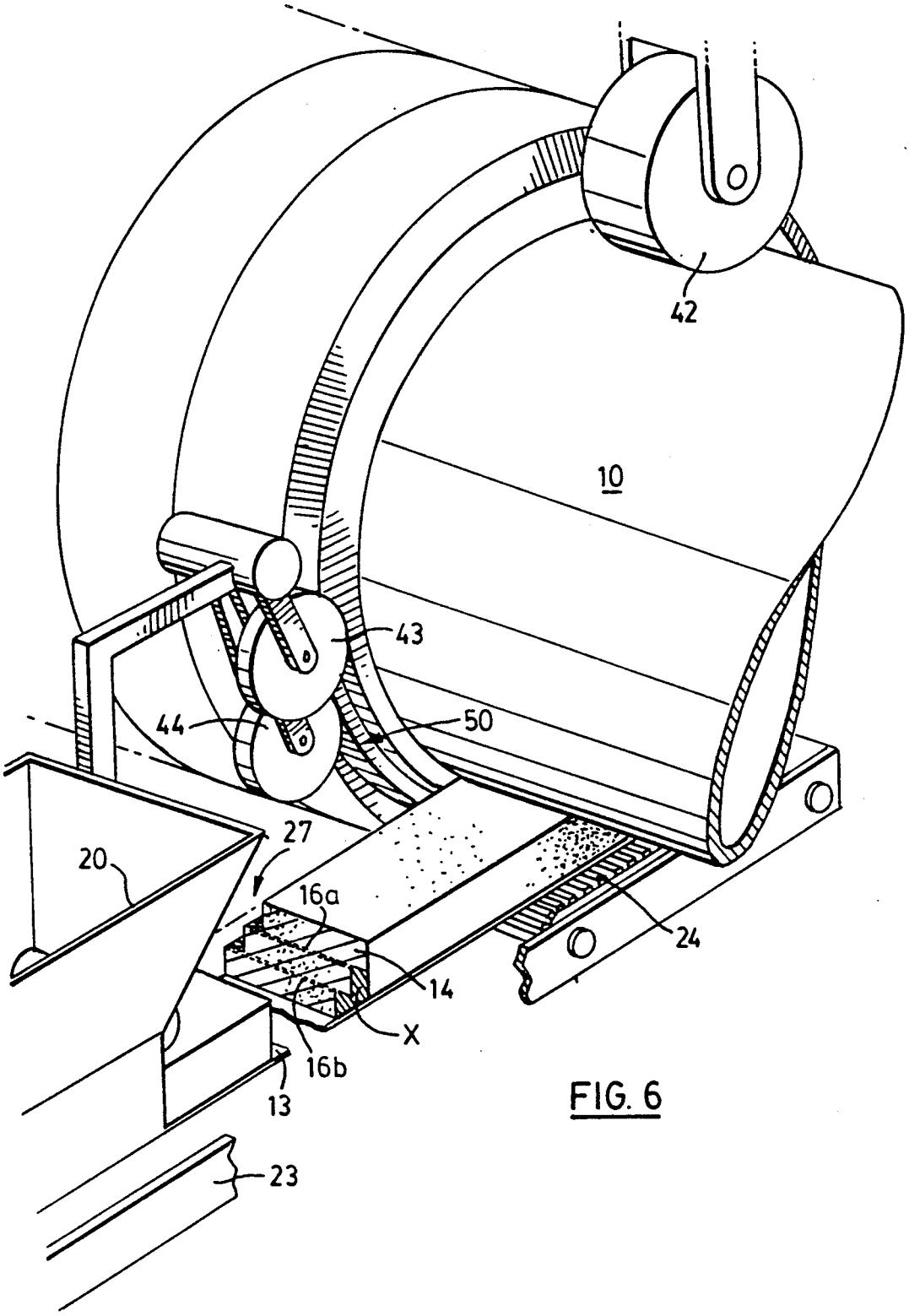
FIG. 6 is an enlarged perspective view showing parts of FIG. 2 in greater detail.

As shown in FIG. 2, the frame 23 includes a yoke 41 at one end which carries a clamping roller 42, the clamping roller engaging the pipe 10 in advance of the wrapping operation to prevent instability in its positioning and to maintain a uniform gap between the bare pipe and the belt 24. Also, as shown in FIGS. 2 and 6, the front end of the hopper 20 adjacent to the pipe carries a pair of trimming rollers 43, 44, the purpose of which will subsequently become apparent.

In use of the apparatus, the pipe 10 is advanced in the direction of its longitudinal axis while being rotated about its axis by the conveyor means 11. The carrier tape 13, supported by an endless conveyor belt 55 (shown in FIG. 5), passes under the rear, middle and front sections of the hopper 20 and onto the conveyor 24 by which the wrapping strip is delivered to the pipe. As the carrier tape 13 passes beneath the hopper 20, concrete fed to the hopper falls directly onto it in the rear hopper section behind the roller 29, which roller performs the dual function of compressing the deposited concrete into a first layer portion and laying the reinforcing mesh 16*b* directly onto it. As the carrier tape, said first layer portion, and the mesh 16*b* are advanced, concrete fed to the hopper falls directly onto the mesh-covered first layer portion ahead of the roller 29 and behind the roller 28. The roller 28 compresses the deposited concrete into a second layer portion superimposed on the first layer portion with the reinforcing mesh 16*b* firmly embedded between them. As in the case of the roller 29, the roller 28 has the further function of laying the reinforcing mesh 16*a* firmly on the second layer portion. Concrete fed to the hopper 20 and falling onto the mesh-covered second layer portion of concrete is similarly compressed into a third layer portion by the forming roller 28. The wrapping strip 12, as it proceeds from the gate at the front end of the hopper, is thus a composite strip comprising the carrier tape 13, and layer of compressed concrete of predetermined thickness carried by the tape, and two layers of accurately positioned reinforcing mesh embedded within the concrete layer.

It is to be noted that the conveyor 24 and the conveyor 55, both mounted on the frame 23, are separate independent conveyors. The purpose of this is to ensure that the compression forces applied at the wrapping stage will not pinch the conveyor belt 24 and so affect its speed.

Figure 5:
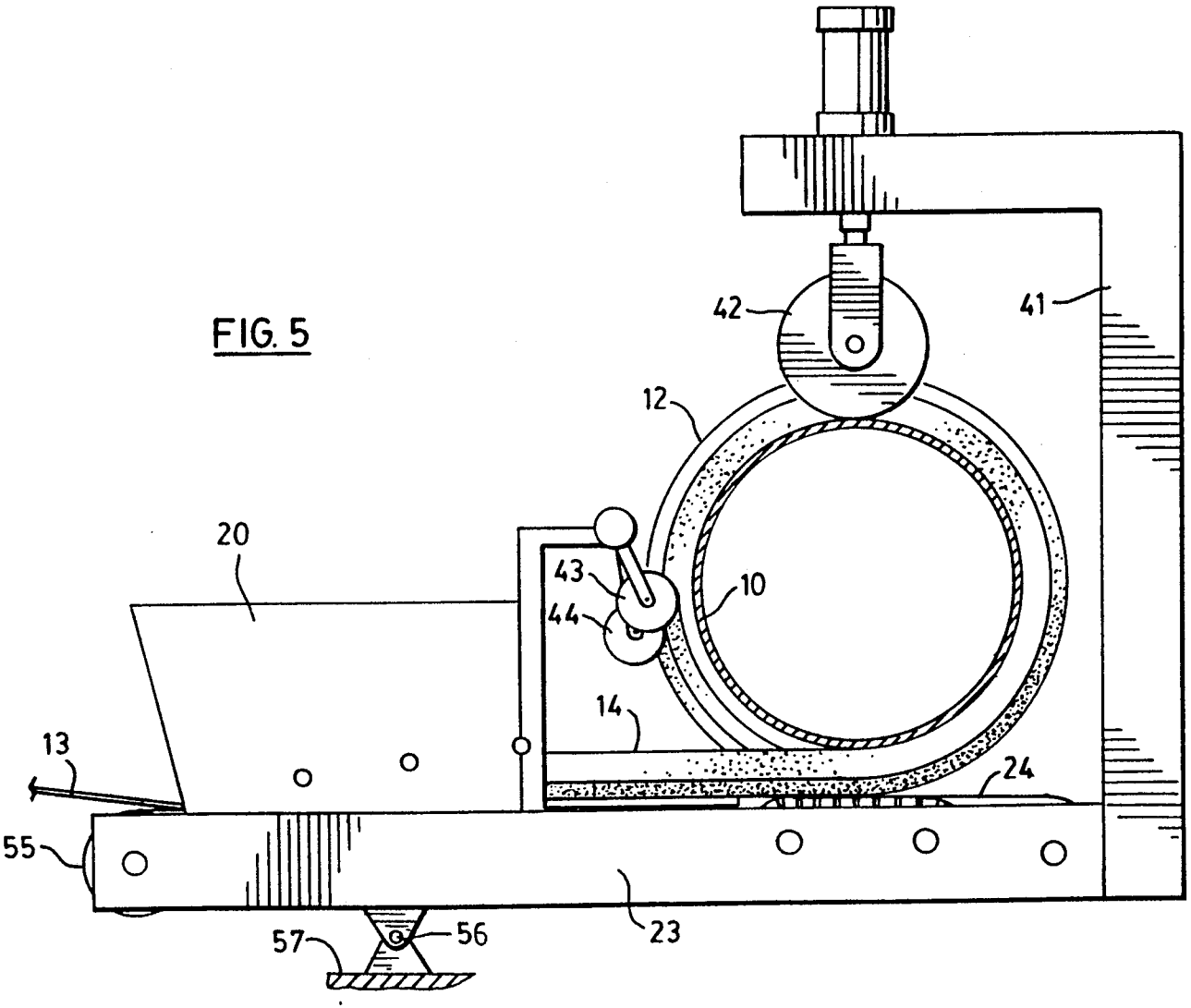
FIG. 5 is a simplified end view in the direction of the arrow 5 in FIG. 2.

An important further feature of the invention is illustrated in FIG. 5. As shown, the frame 23 is hingedly mounted on a rigid structure 57 by means of a hinge 56. The frame 23 carries the endless conveyor 55, the hopper 20, the conveyor 24, and the clamping roller 42 mounted on the yoke 41, so that the whole assembly can float about the axis of the hinge 56 during the pipe coating process. In practice pipe 10 is never perfectly straight and true and so without such a floating assembly irregularities in the pipe would result in an uneven coating. However, the arrangement shown in FIG. 5 will ensure that a fixed distance between the bare pipe and the conveyor 24 is maintained and so ensure that concentricity of the coating is maintained throughout the pipe length.

The notched configuration of the concrete layer carried by the tape 13 is determined by the configuration of the hopper 20. Since the hopper sections are of successively reduced widths from rear to front, the deposited layer portions are also of successively reduced widths, thus defining the notched configuration at one edge of the layer as clearly shown in FIGS. 2 and 6. The opposite edge of the concrete layer is not notched in the same way, but is provided with the necessary notches in a subsequent operation. Referring to FIG. 6, in which part of the wrapping strip has been cut away to show the strip in cross section, the hatched section X denotes a portion of the concrete which still has to be trimmed to form the cooperating notches on that side of the strip. This is accomplished by the trimming rollers 43, 44 which are accurately positioned in relation to the last convolution of strip applied to the pipe so as to form the cooperating notches 50 which will interlock with the formed notches 27 of the next strip convolution as it is applied to the pipe.

I claim:

1. In an apparatus for wrapping pipe comprising first conveyor means for rotating and advancing a pipe in relation to its axis, second conveyor means for conveying to the pipe a continuous strip of wrapping material to be spirally wrapped thereon, the wrapping material comprising a continuous carrier tape on which is deposited a continuous layer of cementatious material, said layer being of predetermined rectangular cross section with one or more continuous notches along one edge thereof, the apparatus further comprising trimming means for trimming one or more complementary notches along the opposite edge as the strip is wrapped onto the pipe, said continuous notches and complementary notches interlocking to form a continuous coating on the pipe, the improvement comprising:

a hopper positioned to deposit the continuous layer of cementatious material onto the carrier tape as the tape is advanced towards said second conveyor means, the hopper having longitudinally extending side walls and front and rear walls, the front wall providing an exit gate for the formed layer of cementatious material, one said side wall being stepped to define a plurality of in-line contiguous hopper sections including at least a rear hopper section and a front hopper section, said hopper sections being of successively reduced widths from rear to front, each hopper section housing a forming roller mounted horizontally across the entire width thereof, the roller of the front section being adjacent to the exit gate, and said forming rollers from rear to front being mounted at successively increasing distances from the carrier tape whereby to compress and form successive layer portions of said deposited cementatious layer and thereby form said layer of predetermined cross section.

2. An apparatus according to claim 1, comprises a plurality of electric motors mounted adjacent to a side wall of the hopper for driving the forming rollers, each motor being coupled to a respective said forming roller through reduction gearing.

3. An apparatus according to claim 2, wherein the continuous layer of cementatious material incorporates at least one layer of reinforcing mesh embedded between a pair of said layer portions.

4. An apparatus according to claim 1, wherein said trimming means comprises one or more notching rollers.

5. An apparatus according to claim 2, wherein said motors are mounted adjacent to said one side wall of the hopper, the other side wall sloping outwardly to form a flared hopper mouth.

6. An apparatus according to claim 1, further comprising an elongate frame on which the hopper and said second conveyor means are mounted, and a clamping roller mounted on the frame vertically above the second conveyor means in predetermined spaced relation thereto, the clamping roller being positioned to engage the pipe for clamping the pipe in position during the wrapping process, wherein the frame is pivotally mounted on a fixed support for pivotal movement about a transverse axis thereby to accommodate irregularities in cylindricity of the pipe.

* * * * *